United States Patent [19]

Rabus

[11] Patent Number: 4,800,707

[45] Date of Patent: Jan. 31, 1989

[54] VERTICAL FORM, FILL & SEAL PACKAGING MACHINE WITH SERVO MOTOR DRIVE MEANS

[75] Inventor: Horst Rabus, Broad Brook, Conn.

[73] Assignee: Package Machinery Company, Longmeadow, Mass.

[21] Appl. No.: 135,175

[22] Filed: Dec. 9, 1987

Related U.S. Application Data

[63] Continuation of Ser. No. 922,071, Oct. 20, 1986, abandoned, which is a continuation-in-part of Ser. No. 690,956, Jan. 11, 1985, abandoned.

[51] Int. Cl.[4] ..... B65B 9/10

[52] U.S. Cl. ..... 53/552; 53/64

[58] Field of Search ..... 53/51, 55, 64, 73, 75, 53/550, 551, 77, 552, 373

[56] References Cited

U.S. PATENT DOCUMENTS

| | | | |
|---|---|---|---|
| 4,128,985 | 12/1978 | Simmons | 53/64 X |
| 4,136,505 | 1/1979 | Putnam et al. | 53/551 |
| 4,525,977 | 7/1985 | Matt | 53/55 |
| 4,546,596 | 10/1985 | Cherney | 53/551 X |
| 4,549,386 | 10/1985 | Wilson | 53/51 |
| 4,553,368 | 11/1985 | Ziller | 53/51 |
| 4,578,931 | 4/1986 | Roovers | 53/551 |

*Primary Examiner*—Robert L. Spruill
*Assistant Examiner*—Beth Tenney
*Attorney, Agent, or Firm*—McCormick, Paulding & Huber

[57] ABSTRACT

A vertical form, fill and seal packaging machine has a tube former for receiving flexible packaging material in thin flat strip form and progressively juxtaposing opposite longitudinal edge portions thereof in parallel vertically extending relationship to provide a depending tube open at the top. A side sealer attaches the vertically extending overlapping edge portions and an end sealer provides vertically spaced horizontally extending transverse or end seals across the tube. A product dispenser discharges measured quantities of product into the tube interior through the former and through the open upper end of the tube. Tube feed means comprise first and second pairs of vertically spaced rolls respectively on opposite external sides of the tube of packaging material and first and second tube feeding belts respectively trained over said pairs of rolls. Inner runs of the belts engage the tube and have vertically extending perforate portions. Vacuum generating means communicate with the perforate portions of the inner runs to cause the belts to grip the tube and back-up means within the tube provide for frictional tube feeding action. A preliminary flat film advancing means is interposed between the source of packaging material and the tube former and is operable intermittently in timed relationship with the tube advancing means beneath the tube former. A servo motor drives both the tube advancing means and the preliminary flat film advancing means through a cog belt-pulley arrangement, or alternatively, three servo motors respectively drive the belts of tube advancing means and the preliminary flat film feed means.

12 Claims, 4 Drawing Sheets

VERTICAL FORM, FILL & SEAL PACKAGING MACHINE WITH SERVO MOTOR DRIVE MEANS

CROSS REFERENCE TO RELATED APPLICATIONS

This is a continuation of co-pending application Ser. No. 922,071, filed on Oct. 20, 1986, in turn a Continuation-In-Part of Ser. No. 690,956, filed Jan. 11, 1985, both abandoned.

BACKGROUND OF THE INVENTION

This invention relates generally to machines for forming, filling and sealing packages made from an elongated thin flat strip of flexible packaging material, the strip of material being first formed to a depending upwardly open tubular configuration, sealed longitudinally at overlapped vertically extending edge portions, sealed transversely along horizontal lines spaced vertically along the tube, and filled from above with measured quantities of product between successive transverse or end sealing operations. More particularly, the invention relates to an improved servo motor drive means for a tube advancing means and a preliminary flat film advancing means in the machine.

Conventionally, in advancing or feeding a flat strip of packaging material through a tube former, a vacuum or vacuum-friction feed belt mechanism is employed. A pair of perforate endless belts are disposed respectively on opposite sides of the depending tube of packaging material beneath the tube former to engage and draw the same downwardly with gripping action provided by a reduced pressure or vacuum condition at the openings in the belt. The belts may also have substantial frictional engagement with the depending tube of packaging material with a suitable back-up means provided within the tube and a positive intermittent tube advancing operation is thus achieved. It is also a conventional practice to include in machines of the type under consideration a preliminary flat film advancing means interposed between the source of packaging material and the tube former. The preliminary flat film advancing means comprises opposing feed rolls, sometimes referred to in the trade as "measuring rolls", and it is a conventional practice to drive the vacuum tube feeding belts at about a 5% higher speed than the preliminary or measuring rolls. This provides a slight slipping action with efficient tube advancing and forming operation being thus provided.

The following patents relate to the type of vertical form, fill and seal packaging machine under consideration and may be referred to for further description and illustration thereof. U.S. Pat. No. 3,986,921, dated Oct. 19, 1976, entitled SEALING JAW MECHANISM FOR PACKAGE MAKING MACHINE; U.S. Pat. No. 4,023,327, dated May 17, 1977, entitled CONTROL SYSTEM FOR PACKAGE MAKING MACHINE; U.S. Pat. No. 4,040,237, dated Aug. 9, 1977, entitled SEALING JAW MECHANISM FOR PACKAGE MAKING MACHINE; U.S. Pat. No. 4,043,098, dated Aug. 23, 1977, entitled VERTICAL FORM, FILL AND SEAL PACKAGING MACHINE WITH IMPROVED BACK-UP BAR FOR LONGITUDINAL SEALING; U.S. Pat. No. 4,118,913 dated Oct. 10, 1978, entitled SHORT PRODUCT DROP VERTICAL FORM, FILL AND SEAL PACKAGING MACHINE; U.S. Pat. No. 4,128,985; dated Dec. 12, 1978, entitled CONTROL SYSTEM FOR PACKAGE MAKING MACHINE; U.S. Pat. No. 4,136,505, dated Jan. 30, 1979, entitled TUBELESS VERTICAL FORM, FILL AND SEAL PACKAGING MACHINE WITH IMPROVED FEED MEANS; U.S. Pat. No. 4,171,605, dated Oct. 23, 1979, entitled VERTICAL FORM, FILL AND SEAL PACKAGING MACHINE WITH IMPROVED SIDE SEALING MEANS; U.S. Pat. No. 4,291,520, dated Sept. 29, 1981, entitled VERTICAL FORM, FILL AND SEAL PACKAGING MACHINE WITH IMPROVED END SEALING AND STRIPPING MEANS.

In the foregoing patents and in the description and claims which follow terminology such as "package" and "bag" is used and is intended to be generally synonymous with other like terms such as "pouch", "envelope", etc. Terms such as "product" and "charges of product" refer to any of a wide variety of package fill which can be accommodated in vertical form, fill and seal machines. The charges of product may be weighed and successively discharged by an associated product feeder, the feeder may provide a volumetric rather than a weight determination of product charge, and other means may also be employed in introducing charges of product, this even including the manual dumping of product into a depending tube or packaging material.

Packaging machines of the type referred to have been generally satisfactory but in certain instances are found wanting in their maximum speed of operation and in other respects. One limiting factor in providing an efficient high speed packaging machine of the type described resides in the drive means for the machine. Conventionally, an electric motor operates through a speed reducer and a clutch-brake system to drive the preliminary or measuring rolls and the vacuum tube feed belts in common. However, in this type of drive system there are severe limitations on the ability to control acceleration and deceleration characteristics of the intermittent feed operation of the film and tube advancing means. At high speeds, there may be unacceptably sharp acceleration and deceleration characteristics tending to jerk the web or film of packaging material and perhaps causing tracking and even breaking problems. A device referred to as a "web brake" is sometimes employed in providing for precise stopping of the web or film of packaging material particularly where printing of the web or film is required. Such "web brakes" are notoriously difficult to adjust and control even at a 60 (BPM) rate of operation of the machine.

Another problem arising at high speed operation of conventional vertical form, fill and seal machines is in the "hydrostatic shock" which occurs when a heavy product falls within a tube and impinges on a still hot seal and which may involve weakening and even rupture of the seal when the bag comes to a sudden stop with a motor-clutch-brake type drive system.

Inaccuracies in printing on the packaging material may also be encountered at high speed operation with the motor-clutch-brake drive system as well as other detrimental effects on machine operation and product quality.

It is the general object of the present invention to provide a vertical form, fill and seal packaging machine with an improved drive means in the form of a servo motor and control means whereby acceleration and deceleration as well as other characteristics can be precisely programmed and controlled during film and tube advancing operation, the machine speed of operation and efficiency thus being greatly enhanced.

SUMMARY OF THE INVENTION

In fulfillment of the aforementioned object and in accordance with the present invention, a vertical form, fill and seal packaging machine is provided with a source of packaging material in the form of an elongated thin flat strip of film comprising successive package blanks as integral contiguous sections thereof. A tube former has a vertically open interior space and is adapted to receive said strip material and in downward passage therethrough form the same to a depending and upwardly opened tubular configuration. Opposite longitudinal edge portions of the strip of material are progressively juxtaposed by the tube former in overlapping parallel and vertically extending relationship. A product dispensing means associated with and positioned atop the tube former is operable intermittently for the gravity discharge of measured quantities of product to and downwardly through the tube former interior space into a tube of packaging material depending therefrom. A longitudinal seam sealing station is disposed beneath the tube former and intermittently rotatable film and tube advancing means beneath the tube former serve to draw the tube downwardly therethrough whereby successively to present integral blanks of film in tubular form and with overlapped longitudinal edge portions extending vertically as aforesaid at the said longitudinal seam sealing station. A vertically extending longitudinal seam sealer at the sealing station adjacent the overlapped edge portions of the tubular blank is movable intermittently generally horizontally toward and away from and thus into and out of sealing engagement with the overlapped edge portions of the blank. An end sealer disposed beneath the tube former and the longitudinal seam sealer is movable intermittently generally horizontally toward and away from and thus into and out of sealing engagement with the tubular blanks whereby to provide vertically spaced horizontal end seals and sequentially to horizontally sever said tubular blanks. The product dispensing means serves to fill the tubular blanks between sequential end sealing and severing operations and the end sealer in its severing operations thus provides individual filled packages or bags.

In accordance with the invention, a servo motor means is connected in driving relationship with the rotatable film and tube advancing means and a motor control means is operatively associated with the motor. The servo motor and motor control means comprise at least one precisely regulable high response electric motor and an associated power supply, amplifier, and controller whereby acceleration and deceleration and other characteristics may be closely controlled during intermittent film and tube advancing operations. The machine speed of operation and efficiency is thus greatly enhanced.

The film and tube advancing means preferably comprises first and second endless tube feed belts each with at least one vertically extending inner run and with said belt inner runs disposed on horizontally opposite external sides of a depending tube of packaging material beneath the tube former and the longitudinal seam sealer. The belts are driven in opposite directions so that their said vertical inner runs move downwardly in unison and in timed relationship whereby to engage the tube of packaging material and to intermittently draw the same downwardly as aforesaid.

Preferably a preliminary flat film advancing means is also provided and is interposed between the source of packaging material and the tube former. The said preliminary flat film advancing means is operable intermittently by the aforesaid servo motor and control means and in timed relationship with said tube advancing means beneath the tube former, the former serving to advance the film in its said flat strip configuration toward the tube former. The preliminary film advancing means may vary but preferably comprises a plurality of small axially spaced feed rolls on one side of the film with a back-up roll provided on an opposite of the film and with the tube advancing means beneath the tube former being operated at a speed slightly in excess of the feed speed of the preliminary film advancing means.

In one embodiment of the present invention, a single servo motor means includes an interconnecting motion transmitting means which is driven thereby and which is connected in driving relationship with each of the aforesaid tube and preliminary film advancing means. In another embodiment of the invention, three (3) servo motors are provided respectively for driving said flat film advancing means and each of said endless tube feed belts in the tube advancing means.

DESCRIPTION OF THE PREFERRED EMBODIMENTS

Figure 1:
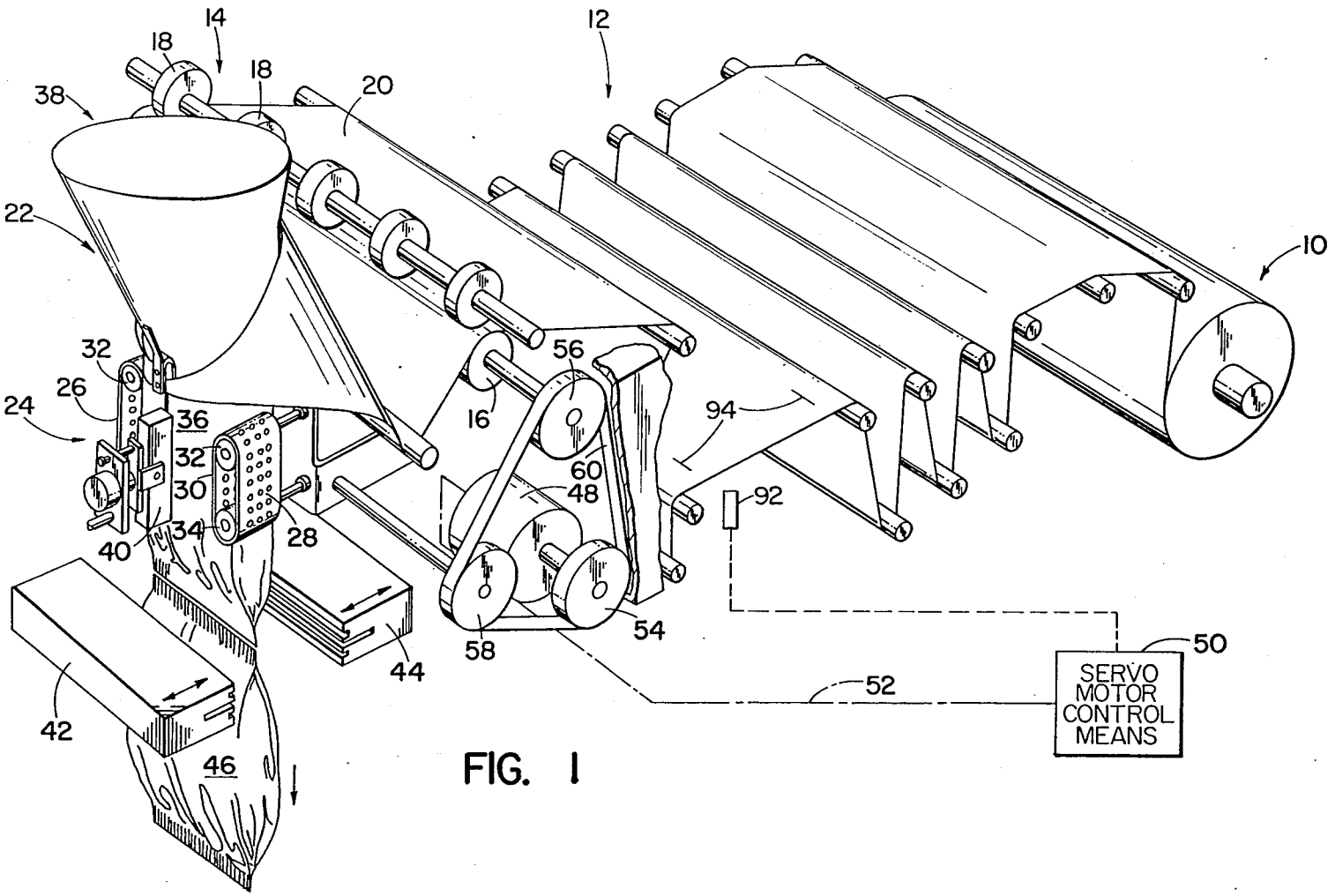
FIG. 1 of the drawings is a perspective view of essential elements of a vertical form, fill and seal packaging machine in schematic form.

Referring now particularly to FIG. 1, it will be observed that a source of packaging material is illustrated schematically in roll form at 10. The material may take the conventional form of a thin flat strip of "film" or "web" which comprises successive package blanks as integral contiguous sections thereof. The packaging material is drawn from the roll 10 in its flat form and passes through a conventional tensioning means indicated generally 12 to a preliminary flat film or web advancing means indicated generally at 14. The preliminary flat film advancing means, also commonly referred to as "measuring rolls", preferably comprises an elongated power driven roll 16 and a plurality of small back-up rolls 18, 18, five shwon. The roll 16 and the back-up rolls 18, 18 are disposed on opposite sides of the film or web 20 which advanced therefrom to a tube former indicated generally at 22. The film 20 is drawn from the rolls 16, 18 to and through the tube former 22 by means of a tube advancing means disposed beneath the former and indicated generally at 24.

The tube advancing means 24 may be conventional in form and, as more fully described and illustrated in the aforementioned patents, comprises first and second endless tube feed belts 26, 28 each with at least one vertically extending inner run, the run 30 of belt 28 being illustrated in FIG. 1. The tube feed belts are trained over upper and lower pulleys 32, 34 and at least one of said pulleys is driven whereby to drive the belts 26, 28 in opposite directions so that their inner belt runs disposed on horizontally opposite external sides of a depending tube of packaging material 36 engage the tube and tend to draw the same downwardly.

Preferably, the belts 26, 28 are of both the friction and vacuum type. That is, the belts are at least partially perforate with a vacuum generating means associated with each belt so as to provide a low pressure or vacuum zone adjacent each belt inner run whereby to cause the said belt runs to grip the tube of material 36 and to intermittently draw the same downwardly. The frictional aspect of the operation of the belts 26, 28 may be provided for with a frictional engagement of the belts with the tube 36 and with a suitable back-up means disposed internally of the tube of material 36.

The tube former 22 may be conventional and operable to convert the film 20 in downward passage therethrough from a flat condition to the depending tubular condition illustrated by the tube 36. The tube former is provided with a vertically open internal space and may have an associated funnel member 38 which may form a part of a product dispensing means for depositing intermittent charges of product into a tube depending from the former 22. Various types of product dispensing means may be provided as mentioned above and product may even be dispensed manually into the funnel 38 in timed relationship with the formation of packages beneath the former 22.

Figure 2:
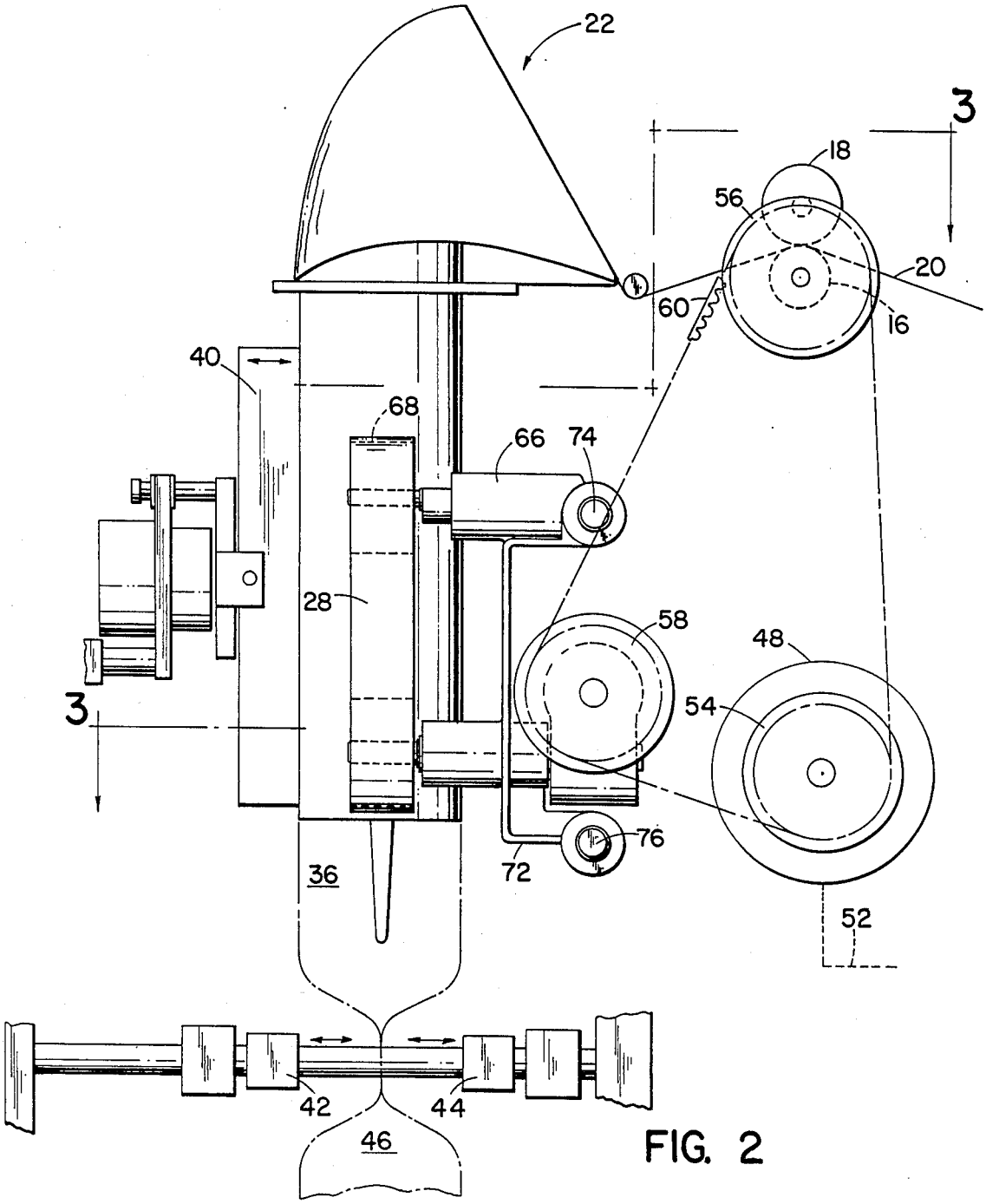
FIG. 2 is a side view of the machine in schematic form.

The belts 26, 28 operate intermittently to successively present integral blanks of film in tubular form and with overlapped longitudinal edge portions extending vertically at a longitudinal seam sealing station beneath the tube former. That is, the longitudinal edge portions of the film material are progressively juxtaposed by the tube former in overlapping parallel and vertically extending relationship and are presented to a longitudinal or side sealer 40 beneath the tube former 22. The side sealer 40 may be conventional in operation and extends vertically as best illustrated in FIGS. 1 and 2 and is intermittently movable generally horizontally toward and away from and thus into and out of sealing engagement with the overlapped edge portions of the depending tube of packaging material. The side seal is thus accomplished on each package or bag and an integral tube of packaging material results.

The form, fill and seal machine also includes an end sealer which is disposed beneath the tube former and the longitudinal or seam sealer and which is intermittently movable generally horizontally toward and away from and thus into and out of sealing engagement with the tubular blank whereby to provide vertically spaced horizontal end seals and sequentially to horizontally sever said tubular blanks. In FIG. 1 elements 42, 44 of an end sealer are shown schematically and are movable horizontally as indicated in their end sealing and package or bag severing operation. The end sealer elements 42, 44 are of course moved horizontally inwardly and outwardly in timed relationship with the side sealer 40 and the intermittent tube advancing operation of the vacuum belts 26, 28. As illustrated in FIG. 1, a lowermost bag 46 has just been severed from the next succeeding bag 36, still integral with the film 20, and it may be assumed that the tube 36 is sealed along its side seam and at the bottom and requires only subsequent top sealing after filling of the tube with product through the funnel 38. The end sealer elements 42, 44 thus seal the top of one bag, the bottom of a next succeeding bag, and sever the bags one from the other.

Figure 3:
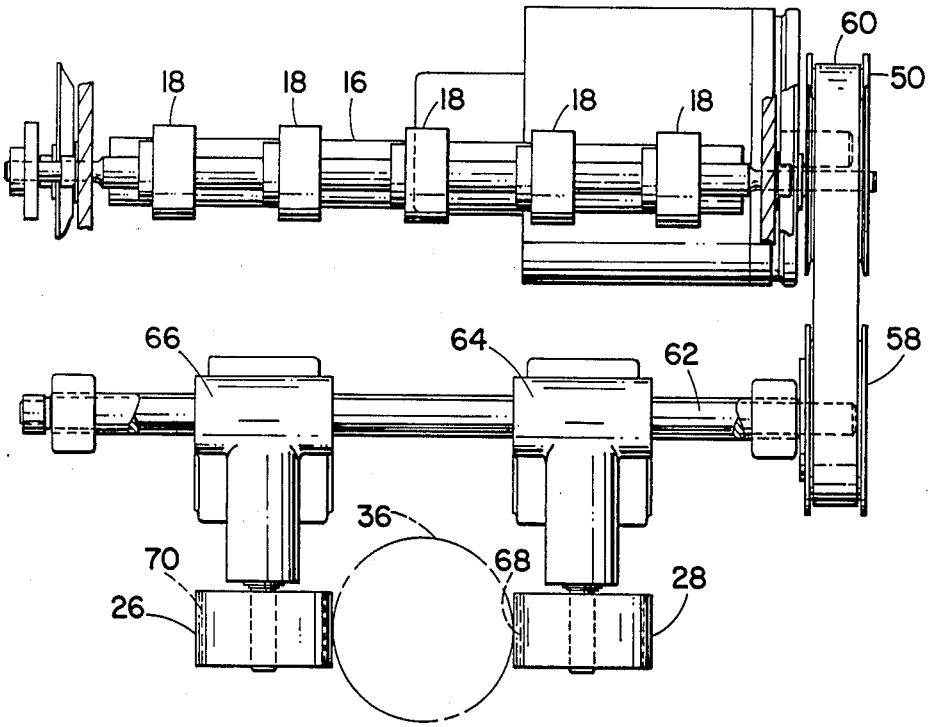
FIG. 3 is a somewhat schematic sectional view taken generally as indicated at 3—3 in FIG. 2.

Referring particularly now to FIGS. 1, 2 and 3, it will be observed that a servo motor means in accordance with the present invention takes the form of a single servo motor 48 having a control means indicated schematically at 50 and connected by broken line 52. The servo motor 48 is a precisely regulable high response electric motor and has an associated power supply, amplifier, and controller at 50 which may include a microprocessor and which in combination provide for the precise programming and control of acceleration, deceleration, and other characteristics of the intermittent film and tube feeding operation of the motor 48 and its driven elements. That is, the motor 48 drives both the preliminary rolls 16, 18 and the vacuum feed belts 26, 28 through a motion transmitting interconnecting means. Preferably, said means comprises a cog belt and pulley arrangement including cog pulleys 54, 56 and 58 and cog belt 60. The pulley 54 is mounted on an output shaft of the motor 48 and in turn drives the pulleys 56 and 58 through the belt 60, the pulley 56 serving to drive the aforementioned roll 16 in the preliminary or measuring flat film advancing means and the pulley 58 serving to drive the vacuum belts 26, 28. In FIG. 3 it will be seen that the pulley 58 drives a horizontal shaft 62 extending to gear boxes 64 and 66 respectively having output pulleys 68 and 70 associated therewith. The gear boxes 64, 68 are adjustable horizontally relative to the shaft 62 by means of mounting brackets 72, 72 one shown in FIG. 2, and mounting bars 74, 76. This enables the pulleys 68, 70 over which the belts 28, 26 are respectively trained to be adjusted toward and away from each other horizontally to accommodate tubes 36 of varying diameter. The gear boxes 64, 66 include bevel gears and drive the pulleys 68, 70 in opposite directions whereby to provide for the opposite driving relationship of the inner runs of the belts 26, 28.

Figure 4:
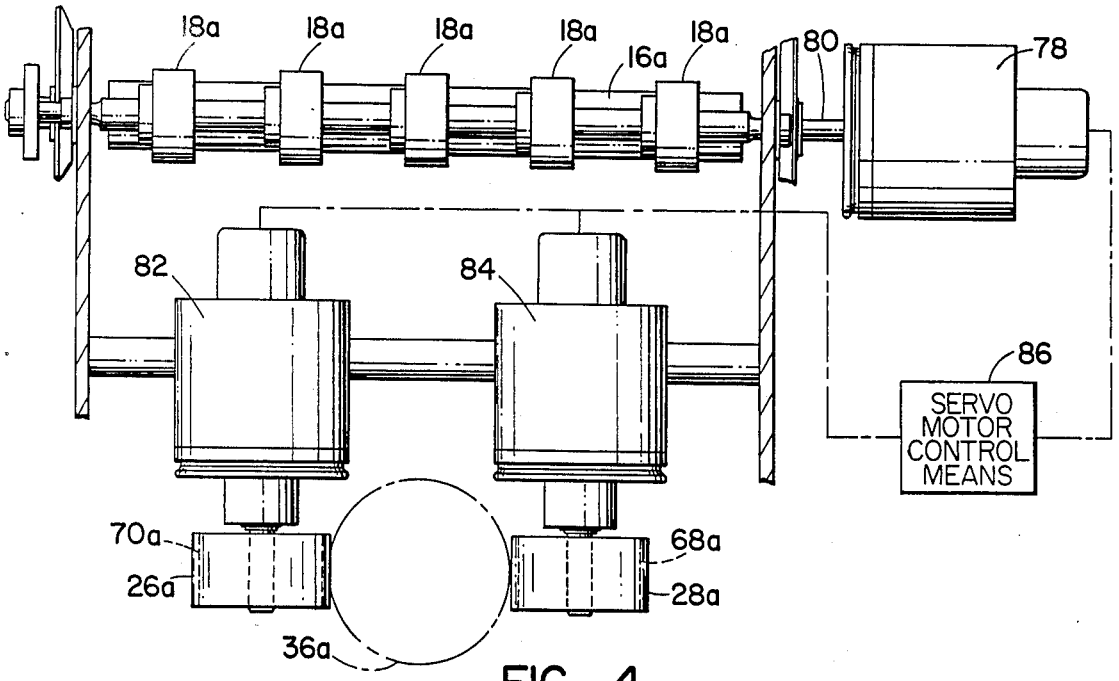
FIG. 4 is a somewhat schematic view similar to FIG. 3 but showing a second embodiment of the present invention wherein small individual servo motors are provided for each of the vacuum feed belt devices and the preliminary or measuring roll.

Referring now particularly to FIG. 4, it will be observed that a first servo motor 78 is connected directly with a shaft 80 extending to a driven roll 16*a* operatively associated with freely rotatable back-up rollers 18*a*, 18*a*. The construction of the rollers 16*a* and 18*a* may be substantially identical with the aforementioned roller 16 and 18 and the roller 16*a* may of course be driven at any desired speed in timed relationship with the vacuum feed belts 26*a* and 28*a*. That is, the vacuum belts 26*a* and 28*a* have associated pulleys 70*a* and 68*a* which are driven respectively by second and third servo motors 82 and 84. The servo motors 82 and 84 may be mounted on brackets in a manner similar to the gear boxes 64, 66 for horizontal movement to in turn move the vacuum belts 26*a*, 28*a* toward and away from a tube 36*a* and to thereby accommodate tubes of varying diameter. The motor and control system of FIG. 4 may be substantially identical with the aforementioned motor and control system 48, 50, 52 with the exception that the three smaller servo motors 78, 82, 84 are provided under the common control of a control means 86 which may include a microprocessor and which serves to synchronize the operation of the motors as required for the establishment of a preselected speed relationship between the rolls 16*a* and 18*a* and the vacuum belts 26*a* and 28*a*. It should also be noted that there is a substantial reduction in inertia with provision of the three small servo motors 78, 82, 84 and the elimination of the larger motor 48, the cog pulley arrangement, the gear boxes 64, 66, etc.

Figure 5:
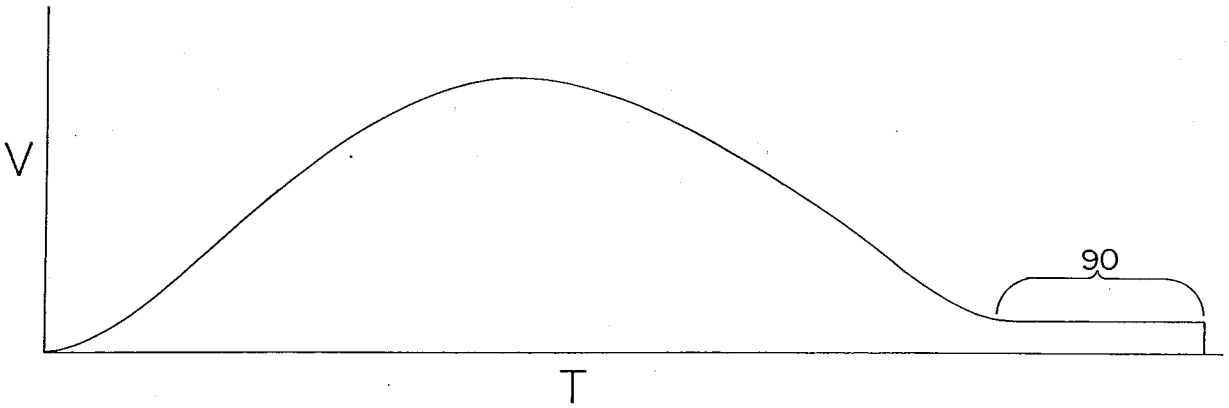
FIG. 5 is a preferred velocity curve provided by the servo motor and control means of the present invention.

With either of the servo motor and control means arrangements of FIGS. 1–3 and FIG. 4, substantial improvement in operation of a vertical form, fill and seal packaging machine is achieved. With the ability to program and precisely control acceleration, deceleration and other characteristics of an intermittent film and tube feeding operation, a substantial improvement in machine speed is achieved. That is, prior art machines have customarily operated in the neighborhood of 60 BPM. The present machine is capable of operation at 120 BPM and perhaps at a substantially higher speed. In FIG. 5 a preferred velocity curve is illustrated for a single film and tube feeding operation. The curve is provided by the servo motor control means such as 50, 86 with the microprocessor in the control means serving to calculate the height and length of the curve as required so that the termination of the film feeding operation will always occur in the "dogleg" portion of the curve indicated at 90 in FIG. 5. As will be apparent, the "dogleg" portion 90 represents a relatively low substantially constant velocity such that termination may occur at any point therealong with a preselected and known elapsed time of deceleration from the constant velocity to zero. This is to be contrasted with the unknown and unpredictable deceleration time encountered with a sharply inclined terminal portion of a conventional velocity curve. The termination point along the "dogleg" may vary as in the case where an encoder is included in the control means for establishing feeding time or bag length and where film slippage and/or stretching may occur. Further, a variable termination condition may be encountered when an electric eye such as the eye 92 is provided (FIG. 1) to read indicia such as 94, 94 on the film. Thus, the "dogleg" 90 is important as is the remainder of the velocity curve and particularly the very low initial rate of acceleration at the beginning of a feeding operation. The curve may be characterized as an asymmetrical modified sine curve with the "dogleg" 90 and with the next derivative starting at zero. Using the foregoing velocity curve, there may also be a possibility of using a somewhat thinner web or film without danger of breakage. Tracking improvement will be quite apparent and there is no slack or jerking movement of the film which tends to cause breaking problems with the preliminary rolls. The ability to precisely control acceleration and deceleration further makes it possible to eliminate the aforementioned web brake which was notoriously difficult to adjust and control. It is even possible to include printing or indicia on the packaging material as mentioned without a web brake. The aforementioned problems of "hydrostatic shock" can also be overcome with the present servo motor drive means and control.

Finally, it may even be possible to provide a smaller bag with little or no shock. There is also substantial improvement in the wear characteristics throughout the entire machine. The significantly lower inertia and the avoidance of shock throughout is of course highly beneficial.

A still further refinement resides in the reversing of the tube or film feed at the end of an intermittent feeding operation. Accurate positioning for pre-printed bags can thus be provided with a deliberate slight overfeed and a short pull back. A deliberate overfeed with a partial closing of the end sealing jaws and a short pull back will also result in a desired stripping operation serving to compact the product, reduce head space thus shortening the bag and effecting a substantial saving on film. In providing for a slight overfeed and a short return feed at the end of an intermittent feeding operation, various sensing means may of course be readily accommodated with the control means. An electric eye, a proximity sensor, an encoder or even a small mechanical sensor may prove effective.

I claim:

1. A vertical form, fill and seal packaging machine having a source of packaging material in the form of an elongated thin flat strip of film comprising successive package blanks as integral contiguous sections thereof, a tube former having a vertically open interior space and adapted to receive said strip material and in downward passage therethrough form the same to a depending and upwardly open tubular configuration, opposite longitudinal edge portions of the material being progressively juxtaposed by said tube former in overlapping, parallel, and vertically extending relationship, a product dispensing means associated with said tube former and operable intermittently for the gravity discharge of measured quantities of product to and downwardly through said tube former interior space into a tube depending therefrom, a longitudinal seam sealing station disposed beneath said tube former, intermittently rotatable film and tube advancing means beneath said tube former intermittently advancing said tube downwardly therethrough whereby successively to present integral blanks of film in tubular form and with overlapped longitudinal edge portions extending vertically as aforesaid at said longitudinal seam sealing station, a vertically extending longitudinal seam sealer at said sealing station adjacent the overlapped edge portions of a tubular blank and intermittently movable generally horizontally toward and away from and thus into and out of sealing engagement with the overlapped edge portions of the blank, an end sealer disposed beneath said tube former and longitudinal seam sealer and intermittently movable generally horizontally toward and away from and thus into and out of sealing engagement with the tubular blank whereby to provide vertically spaced horizontal end seals and sequentially to horizontally sever said tubular blanks, said product dispensing means serving to fill the tubular blanks between sequential end sealing and severing operations and said end sealer thus providing individual filled packages in its severing operation, servo motor means connected in driving relationship with said rotatable film and tube advancing means, and motor control means operatively associated with said motor, said servo motor and control means comprising at least one precisely regulable high response electric motor and associated power supply, amplifier, and controller whereby acceleration and deceleration characteristics may be closely controlled during film and tube advancing operation said control means providing for an intermittent film and tube advancement cycle characterized by a low initial rate of acceleration and a low substantially constant velocity during the terminal portion of the cycle such that termination of the cycle may occur with a preselected and known elasped time of deceleration from said substantially constant velocity to zero velocity.

2. A vertical form, fill and seal packaging machine as set forth in claim 1 wherein said film and tube advancing means comprises first and second endless tube feeding belts each with at least one vertically extending inner run and with said two belt inner runs disposed on horizontally opposite external sides of a depending tube of packaging material beneath said tube former and longitudinal seam sealer, said belts being driven in opposite directions so that their said vertical inner runs move downwardly in unison and engage said tube of packaging material to draw the same downwardly as aforesaid.

3. A vertical form, fill and seal packaging machine as set forth in claim 2 wherein said first and second tube feed belts are at least partially perforate and include vacuum generating means operable at least along their said inner runs whereby to cause the said belt runs to grip said tube of packaging material and to draw the same downwardly.

4. A vertical form, fill and seal packaging machine as set forth in claim 2 wherein said first and second tube feed belts are adapted to frictionally engage and grip said tube of packaging material whereby to draw the same downwardly as aforementioned.

5. A vertical form, fill and seal packaging machine as set forth in claim 2 wherein said first and second tube feed belts are at least partially perforate and include vacuum generating means operable at least along their said inner runs whereby to cause the said belt runs to grip said tube of packaging material and to draw the same downwardly, and wherein said first and second tube feed belts are also adapted to frictionally engage and grip said tube of packaging material whereby to draw the same downwardly as aforementioned.

6. A vertical form, fill and seal packaging machine as set forth in claim 1 wherein a preliminary flat film advancing means is interposed between said source of packaging material and said tube former and is operable intermittently by said servo motor and control means and in timed relationship with said tube advancing means beneath said tube former to advance said film in its said flat strip configuration toward said tube former.

7. A vertical form, fill and seal packaging machine as set forth in claim 6 wherein said preliminary film advancing means comprises at least two feed rolls arranged in opposing relationship with the film engaged therebetween and in driven relationship therewith, the tube feed speed provided by said tube advancing means beneath said tube former being slightly in excess of the flat film feed speed as provided by said preliminary film advancing means.

8. A vertical form, fill and seal packaging machine as set forth in claim 7 wherein said preliminary film advancing means comprises a plurality of small axially spaced feed rolls on at least one side of said film, and wherein said tube advancing means beneath said tube former comprises first and second feed belts each with at least one vertically extending inner run and with said two belt inner runs disposed on horizontally opposite external sides of a depending tube of packaging material beneath said tube former and longitudinal seam sealer, said belts being driven in opposite directions so that their said vertical inner runs move downwardly in unison and engage said tube of packaging material to draw the same downwardly as aforementioned.

9. A vertical form, fill and seal packaging machine as set forth in claim 8 wherein said tube and preliminary film advancing means are driven in common from a single servo motor, said servo motor means including a single servo motor and an interconnecting motion transmitting means driven thereby and connected in driving relationship with each of said tube and film advancing means.

10. A vertical form, fill and seal packaging machine as set forth in claim 9 wherein said interconnecting motion transmitting means takes the form of a cog pulley and belt driving apparatus.

11. A vertical form, fill and seal packaging machine as set forth in claim 8 wherein said servo motor means comprises at least two servo motors respectively driving said preliminary flat film advancing means and said tube advancing means.

12. A vertical form, fill and seal packaging machine as set forth in claim 11 wherein three servo motors are provided respectively for driving said flat film advancing means and each of said endless tube feed belts.

* * * * *